US006193121B1

(12) United States Patent
Chang

(10) Patent No.: US 6,193,121 B1
(45) Date of Patent: Feb. 27, 2001

(54) FASTENING DEVICE FOR GOLF IMPLEMENT SET

(76) Inventor: Chen-Te Chang, No. 6, Lane 49, Jen-I Street, Wu-Jih Hsiang, Taichung Hsien (TW)

( * ) Notice: Subject to any disclaimer, the term of this patent is extended or adjusted under 35 U.S.C. 154(b) by 0 days.

(21) Appl. No.: 09/312,966

(22) Filed: May 17, 1999

(51) Int. Cl.[7] ..... A45F 5/00

(52) U.S. Cl. ..... 224/251; 206/315; 206/5; 224/240; 224/269; 224/918

(58) Field of Search ..... 224/251, 240, 224/269, 271, 272, 918, 245, 666, 651, 682, 683, 684, 680, 931, 249, 678, 679; 206/315.5; 24/3.11

(56) References Cited

U.S. PATENT DOCUMENTS 2,665,830 * 1/1954 Fowler ..... 224/681 X
3,091,378 * 5/1963 O'Dwyer ..... 224/682 X
3,753,519 * 8/1973 Gammon ..... 224/918 X
4,730,728 * 3/1988 Larkin ..... 224/680 X
4,736,877 * 4/1988 Clark ..... 224/918 X
5,489,051 * 2/1996 Robinson ..... 224/680 X
5,899,371 * 5/1999 Weliver ..... 224/918 X

* cited by examiner

*Primary Examiner*—Gregory M. Vidovich
*Assistant Examiner*—Maerena W. Brevard
(74) *Attorney, Agent, or Firm*—Bacon & Thomas

(57) ABSTRACT

A fastening device for holding a golf implement set is described. The fastening device includes a fastening stand having a clip attached to one side thereof for attachment to a person's belt. A plurality of embedded channels is attached to the other side of the fastening stand. The embedded channels are formed by ribbed strips and are adapted to hold ball location markers, mending tools, a brush, etc. A plurality of openings are provided along a top surface of the fastening stand. The openings are sized to permit insertion of different sized golf tees into the fastening stand. In addition, the openings include resilient clip members for resiliently holding the golf tees. The fastening device firmly holds the golf implement set in place so that they do not drop when a golfer is using the fastening device while playing golf.

6 Claims, 11 Drawing Sheets

FASTENING DEVICE FOR GOLF IMPLEMENT SET

BACKGROUND OF THE INVENTION

The present invention relates to a fastening device for golf implement set, and more particularly to a fastening device facilitating golfers to use the implements and being not apt to be dropped.

Since golf trolleys are not allowed to get into the teeing ground and putting green in most of the golf fields, and these golf fields with 18 holes having quite a long distance apart are very vast in their ranges, golf implements such as tees, ball location markers, mending tools (implements for repairing indentation on the putting green), brushes etc. which are necessity for the golfer are not convenient to keep in golfers' pocket as these implements might not only pierce through golfers' pocket and even hurt their body but also cause disturbance during the course of golf playing. Besides, it is very inconvenient to search for the very implement the golfer intending to use in the pocket where all kinds of implements are contained in a mess in their pocket.

Referring to a prior art as shown in FIG. 1, a connecting strip is set up fixing to the buckled clip which can clip to the golfers' waist-belt to be taken along with, and four snap holders are set up on the connecting strip for the tees of all sizes to be inserted in order to be available for the use of golfers. But the tees are apt to drop through the opennings of snap holders since the lower portion of the tees have an inclination and the size of tees are all different, besides, those snap holders are only for holding tees, and the rest of implements are still contained in golfers' pockets.

Referring to another prior art which is an integral forming fastener stand as shown in FIG. 2, a plurality of embedded holes are set up at the circumferential flange of the fastening stand on one side while a buckled clip which can be clipped at the golfers' waist-belt is set up on the other side just like that of the prior art shown in FIG. 1. Although this kind of fastening stand can hold all of the implements such as tees, ball location markers, mending tools, brushes etc., the size of the fastening stand is quite bulky such that it is not possible to clip it at the golfers' waist in any direction. If the fastening stand were held in the front or on the back of the golfers, not only that it will interfere the driving and putting of the golfers but also that it will be inconvenient for the golfers to access those implements. Moreover, since the surrounding of those embedded hole is very thin without any resilient clips nor any relatively large space available for fastening, any activities of the golfers such as twisting their bodies for driving, jogging, jumping, crouching, sitting or even walking around will cause the dropping of the implements.

In view of the above-mentioned disadvantages of the prior art, the present invention provides a fastening device that not only can tightly hold all kinds of implements such as tees, ball location markers, mending tools, brushes etc., but also can facilitate the access of those implement set.

SUMMARY OF THE INVENTION

Therefore, the primary objective of the present invention is to provide a fastening device which can tightly hold all kind of implements such as tees, ball location markers, mending tools, brushes etc. and can facilitate the access of those implements as the fastening device of the present invention is small in size, thereby, can be attached at any appropriate location around the waist without interfering the driving and putting of the golfers.

The secondary objective of the present invention is to provide a fastening device which uses resilient clipping pieces to clip tees, and uses relatively large space to contain ball location markers, mending tools, brushes etc. in order to be taken along with golfers without dropping whenever golfers twist their bodies to perform driving, walking around, jumping, jogging, crouching or sitting Another objective of the present invention is to provide a fastening device which can vary the disposition of each portion of the device, for instance, to remove all the embedded channels and ribbed strips on the opposite side of the buckled clip of the fastener stand to become a smooth surface in order to let golfers carry different sizes of tees with relatively light burden, or leave only an embedded channel and its corresponding ribbed strip as well as penetration hole which make the tips of tees be inserted in so as to avoid the tees being dropping and to avoid those sharp tips of tees being exposed to cause hazard.

To sum up, in order to achieve the foregoing objectives, the implemented technology of the present invention is as follows:

The present invention relates to a fastening device for golf implement set. The invention comprises a fastening stand having a buckled clip, a plurality of embedded channel formed by ribbed strips, and a clipping device formed by making use of resilient clipping pieces, in this way, the present invention can tightly fasten various kinds of implements such as tees, ball location markers, mending tools, brushes etc. at the waist-belt of golfers to facilitate golfers to carry them along for accessing during the course of golf playing such that the implements can be tightly held without dropping while the golfers perform any kinds of activities such as driving by twisting their bodies or walking around, jogging, jumping, crouching, and sitting etc.

DETAILED DESCRIPTION OF THE PREFERRED EMBODIMENT

Figure 1:
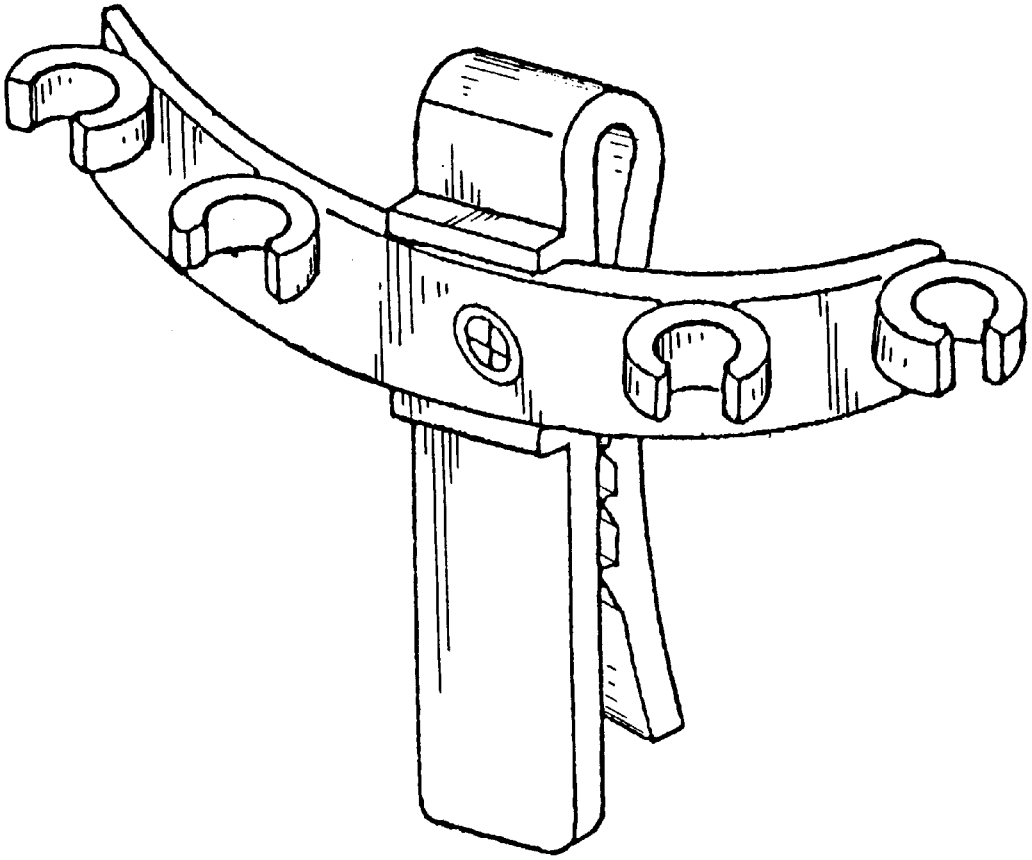
Fig.1 PRIOR ART
FIG. 1 is the outward appearance of buckled clip device of the prior art of the first kind.
Figure 2:
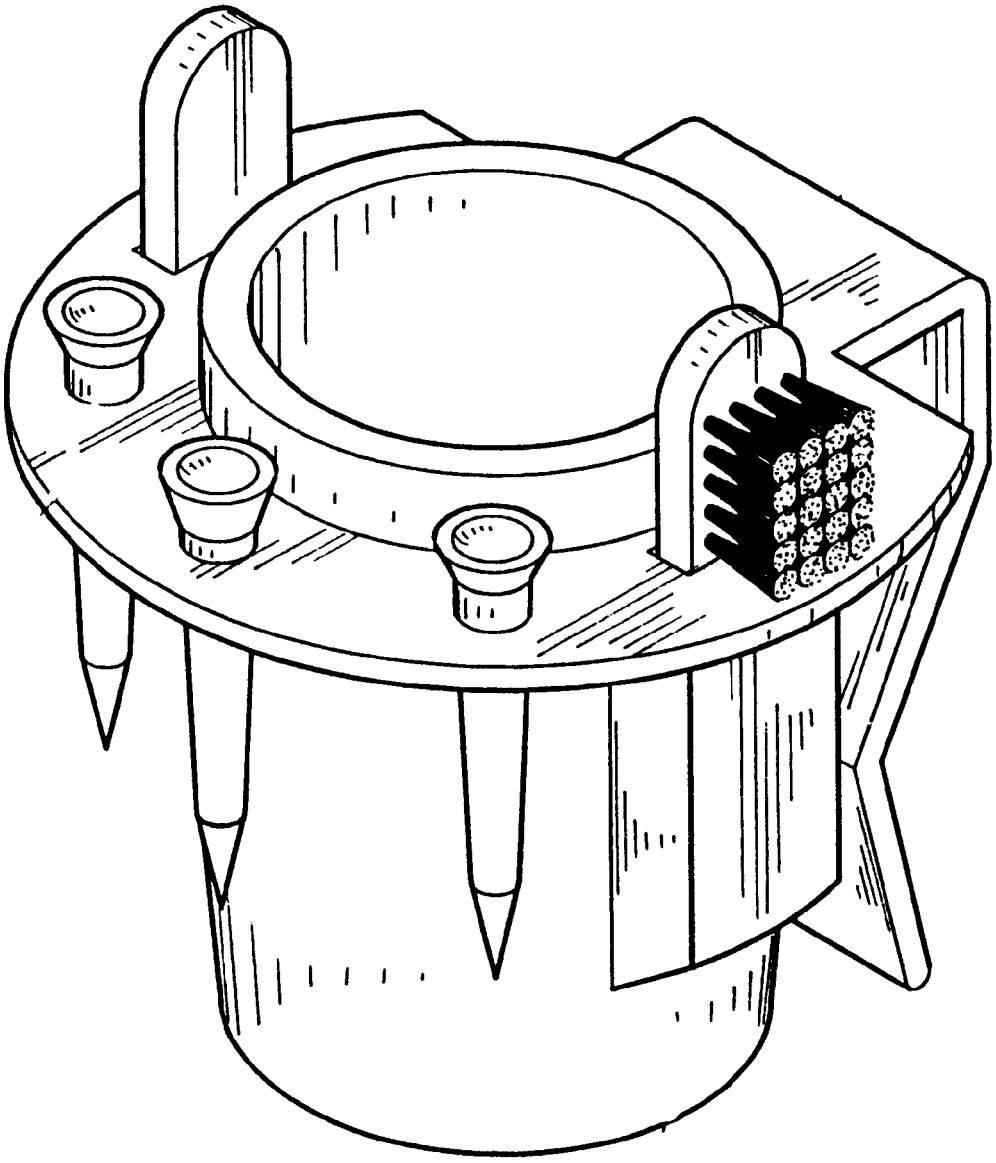
Fig.2 PRIOR ART
FIG. 2 is the outward appearance of fastening device of the prior art of the second kind.
Figure 3A:
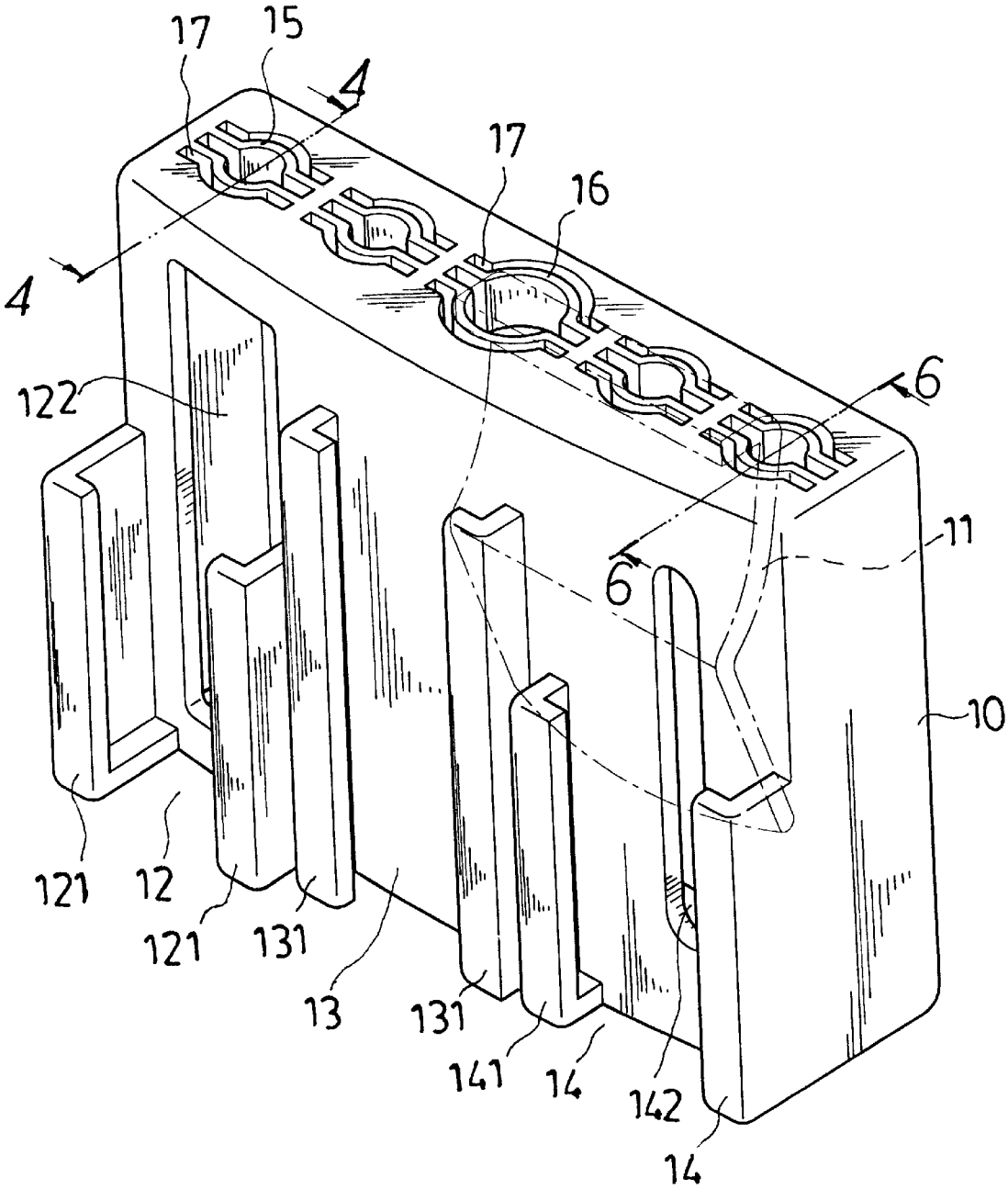
FIG. 3A is the isometric view of the outward appearance of the present invention.
Figure 3B:
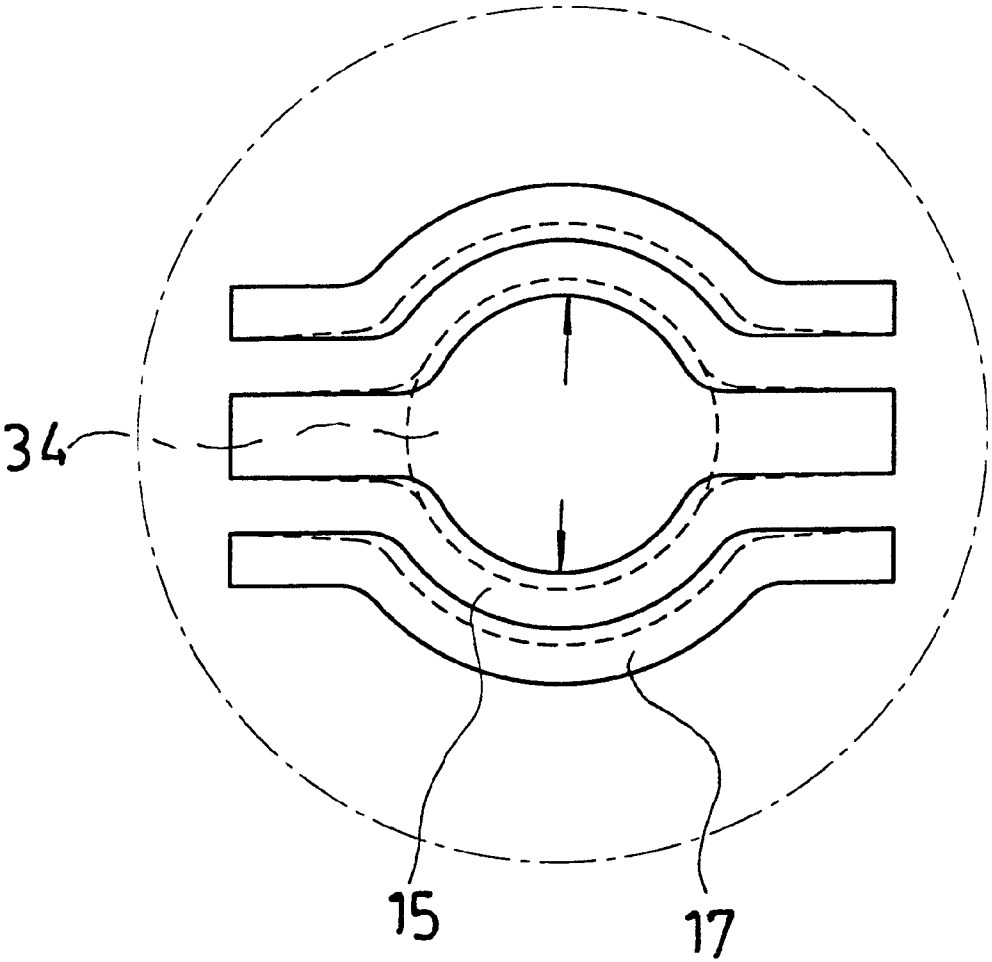
FIG. 3B is the schematic top view showing the enlarged resilient clipping pieces in action of the present invention.
Figure 4:
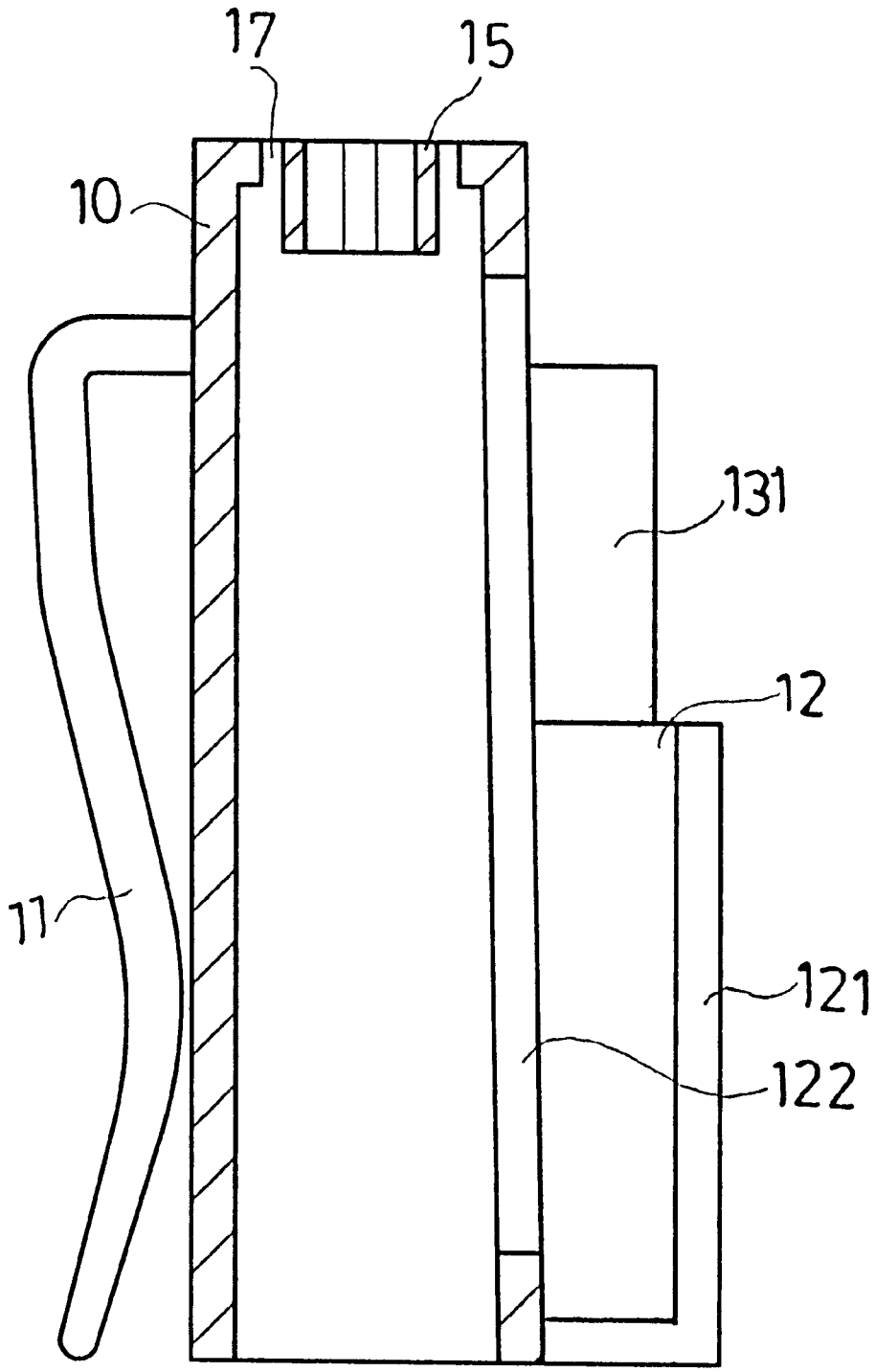
FIG. 4 is the cross-sectional view at cross-section 4—4 shown in FIG. 3A.
Figure 5:
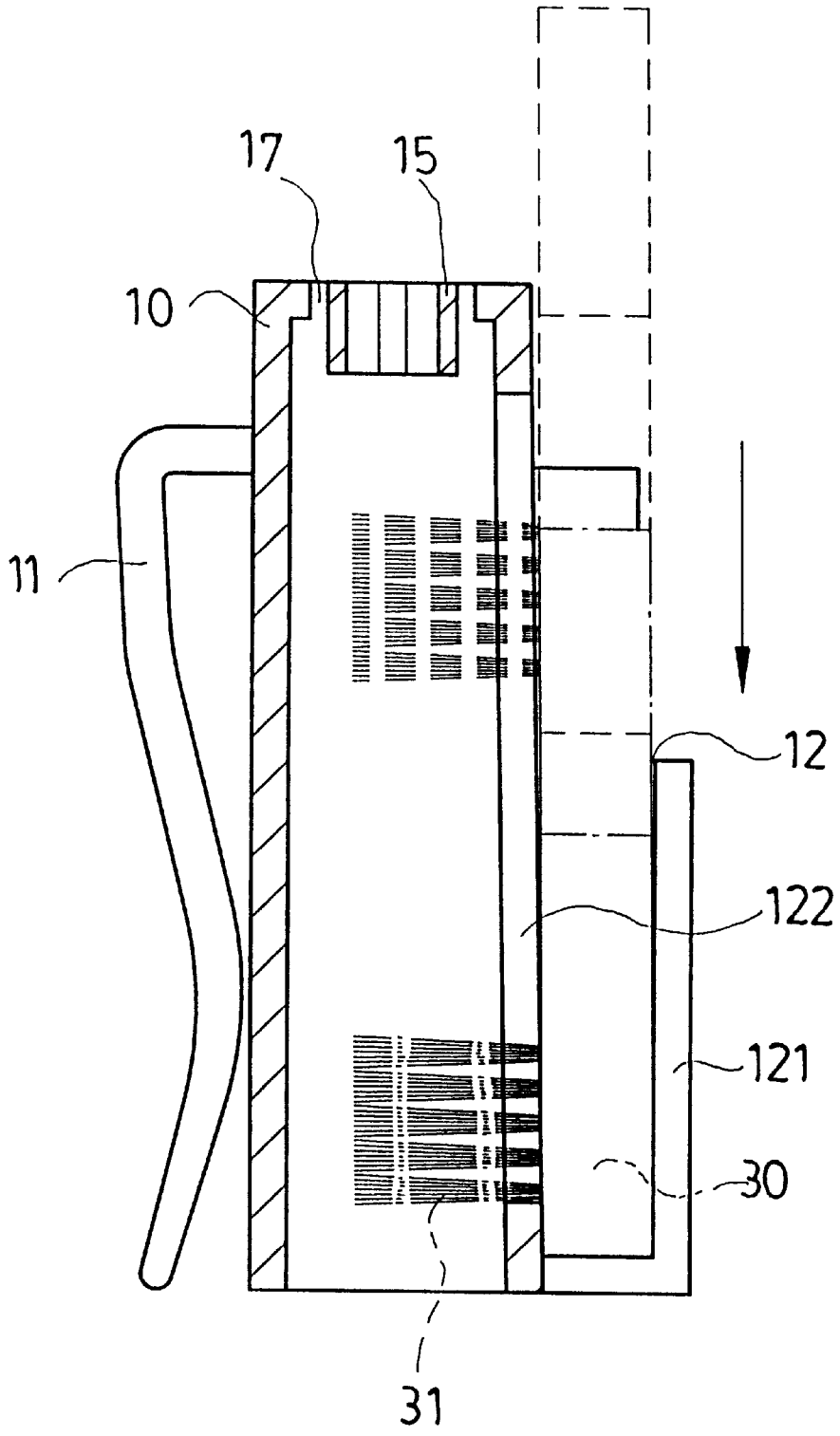
FIG. 5 is the schematic diagram showing the action of the embodiment of the present invention in FIG. 4.
Figure 6:
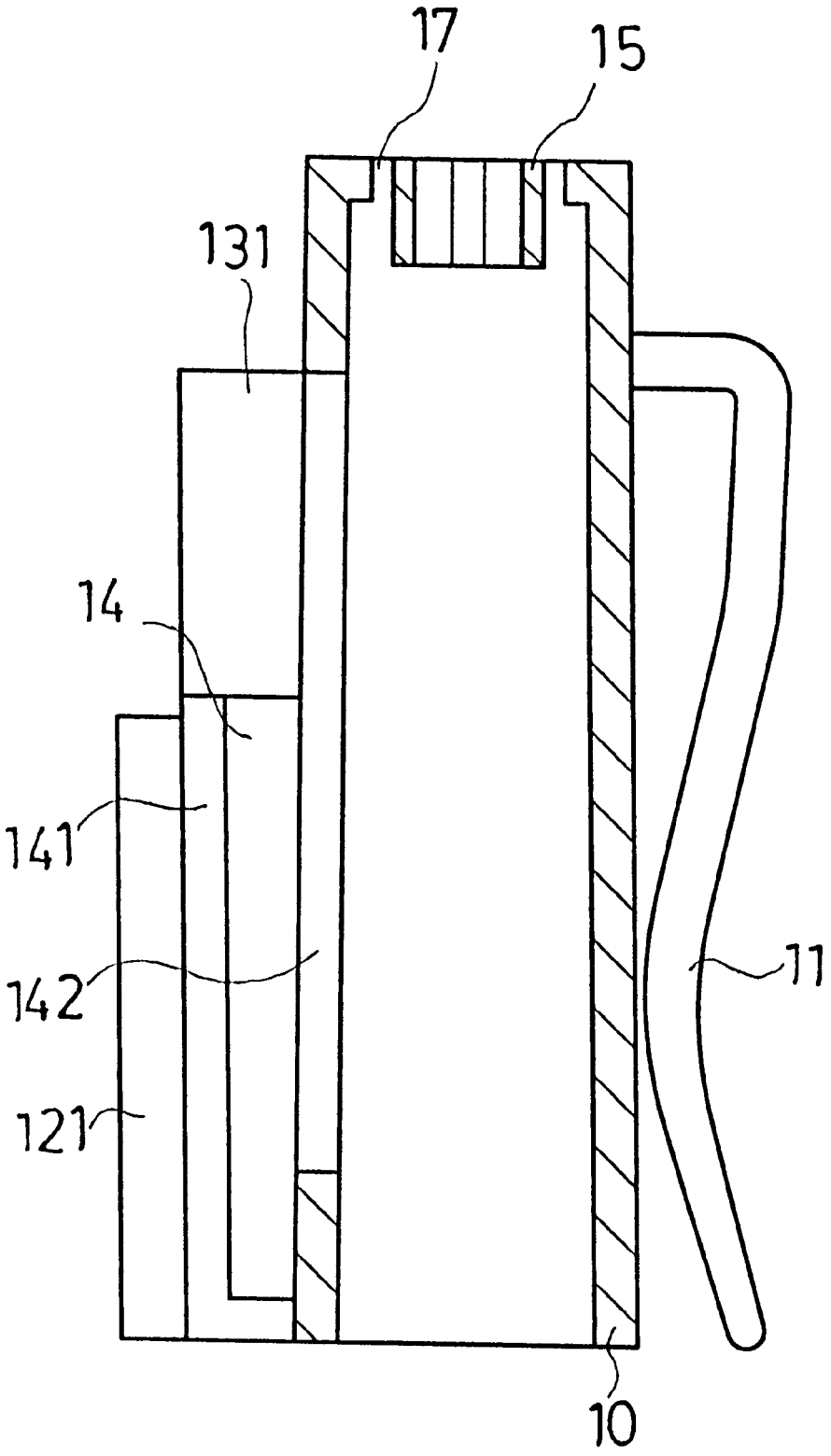
FIG. 6 is the cross-sectional view at cross-section 6—6 shown in FIG. 3A.
Figure 7:
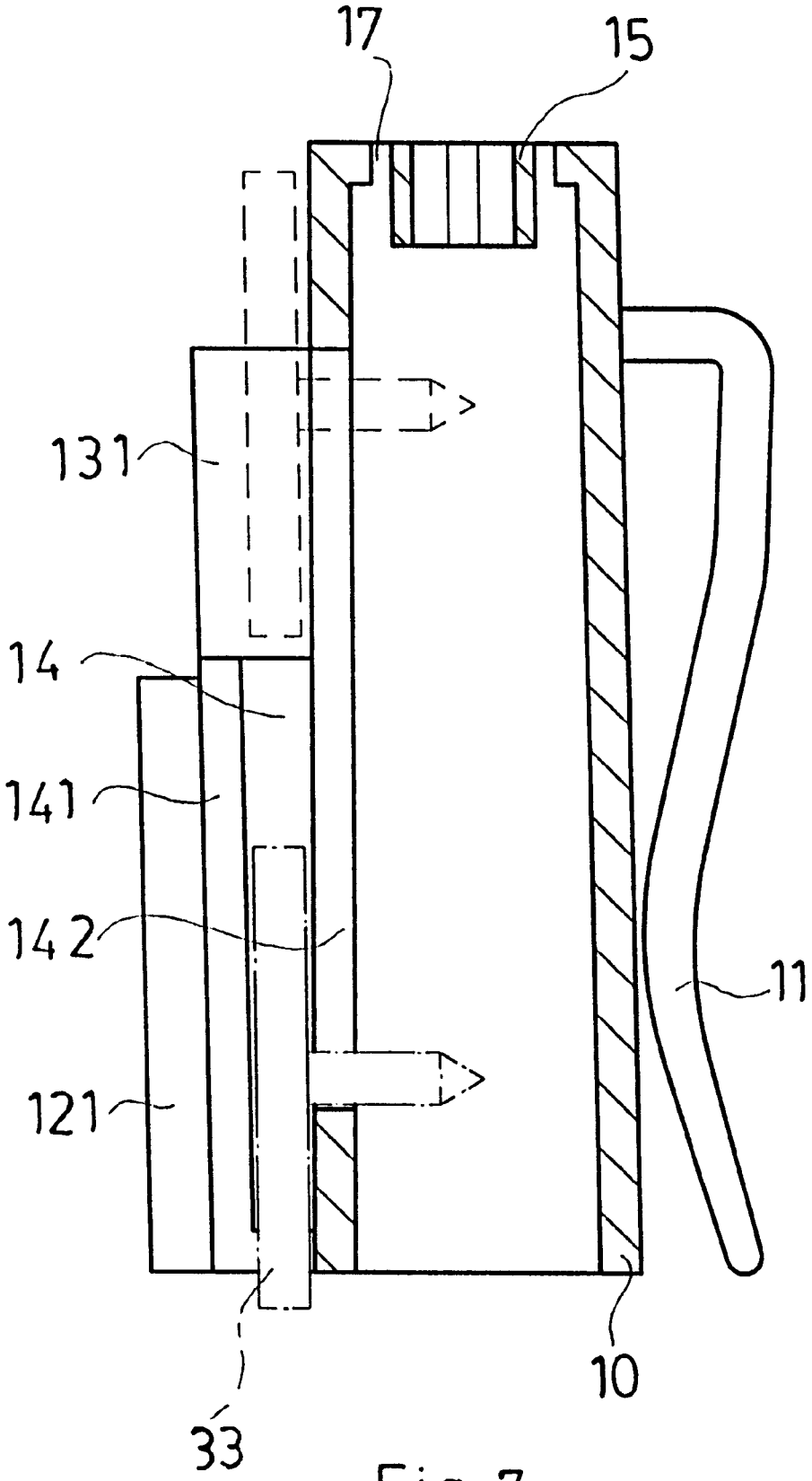
FIG. 7 is the schematic view showing the action of the embodiment of the present invention in FIG. 6.
Figure 8:
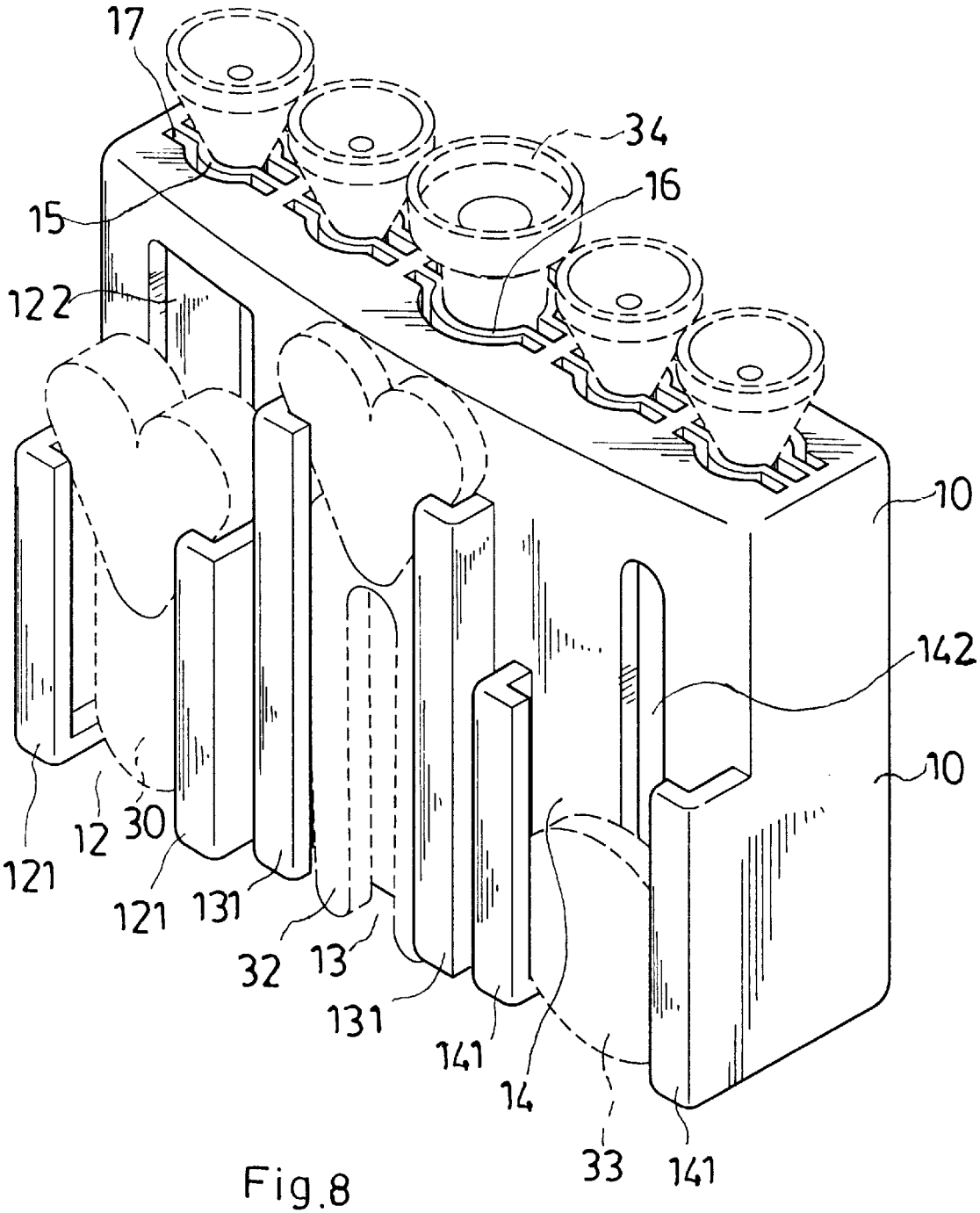
FIG. 8 is the embodiment of the present invention in FIG. 3A.

Referring to FIG. 3A through FIG. 8, the present invention comprises a fastening stand 10 which is a hollow rectangular body with its opening facing downward wherein one side of the fastening stand 10 has a set-up of buckled clip 11 for clipping at the golfers'waist-belt, while a first, second and third embedded channels 12, 13, 14 are set up on the other side of the fastening stand 10 which are L-shape ribbed strips 121, 131, 141 respectively in pairs having various lengths wherein a rectangular opening 122 as shown in FIG. 4, 5 is set up in the first embedded channels 12 for containing the brush hair 31 of a brush 30 as the brush 30 is inserted in the channel 12 to protect the brush hair 31 from being damaged by external scraping, and the second embedded channel 13 is for containing mending tool 32 having sharp tip, while the third embedded channel 14 having a set-up of long slot 142 as shown in FIG. 6, 7 with the bottom end of the ribbed strip 141 in closed type of connection connected to the side surface of the fastening stand 10 is provided for ball location marker 33 to be inserted in the third embedded channel 14 to facilitate the sharp end of the ball location marker 33 hiding in the long slot 142 in order to avoid the dropping of the ball location marker 33 and also to protect golfers from being pricked by the sharp tip of the ball location marker 33, moreover, a plurality of resilient clipping pieces 15, 16 having symmetrical pair with their both ends extended outward to form resilient clipping device are set up at the top of the hollow fastener stand 10 between the buckled clip 11 and each of the adjacent embedded channels 12, 13, 14 while slots 17 are also set up on each side of the resilient clipping pieces 15, 16 to allow the elastically expansive spaces for clipping different sizes of tees 34 as shown in FIG. 3B.

To summarize the foregoing description, the present invention makes use of the first, second, third embedded channels 12, 13, 14 and resilient clipping pieces 15, 16 to tightly clip the brush 30, the mending tool 32, the ball location marker 33, and tees 34 in the fastening stand 10 wherein the brush hair 31 of the brush 30 is stored in the rectangular opening 122 to protect the brush hair 31 from being scrapped by external force, and the sharp tip of the mending tool 32 is hid in the second embedded channel 13 as well as the sharp tip of the ball location marker 33 is hid in the long slot 142 of the third embedded channel 14 to avoid the hazard of hurting any persons in the golf field, besides, various size of tees 34 are tightly held by the resilient clipping pieces 15, 16 having the elastically expansive spaces on each side in order to protect tees from dropping, moreover, the buckled clip 11 clippling at the waist-belt is accommodated to facilitate golfers to carry them along for accessing during the course of golf playing such that the implements can be tightly held without dropping while the golfers perform any kinds of motion such as driving while golfers perform activities such as driving by twisting their bodies or walking around, jogging, jumping, crouching, and sitting etc.

What is more, since the present invention is in pocket size, it can be clipped in the front part of the golfers' waist-belt or any other appropriate locations without affecting driving and putting of the golfers, and the resilient clipping pieces can be employed to clip tees, or a relatively large space can be used to fasten the ball location markers, mending tools, brushes etc. so as to avoid being dropped or damaged or to avoid hurting anybody because of the sharp tip of the implements, besides, the present invention can hold the implements without dropping while the golfers twist their bodies for driving, or the golfers perform any activities like walking around, jumping, jogging, crouching, sitting etc.

Figure 9:
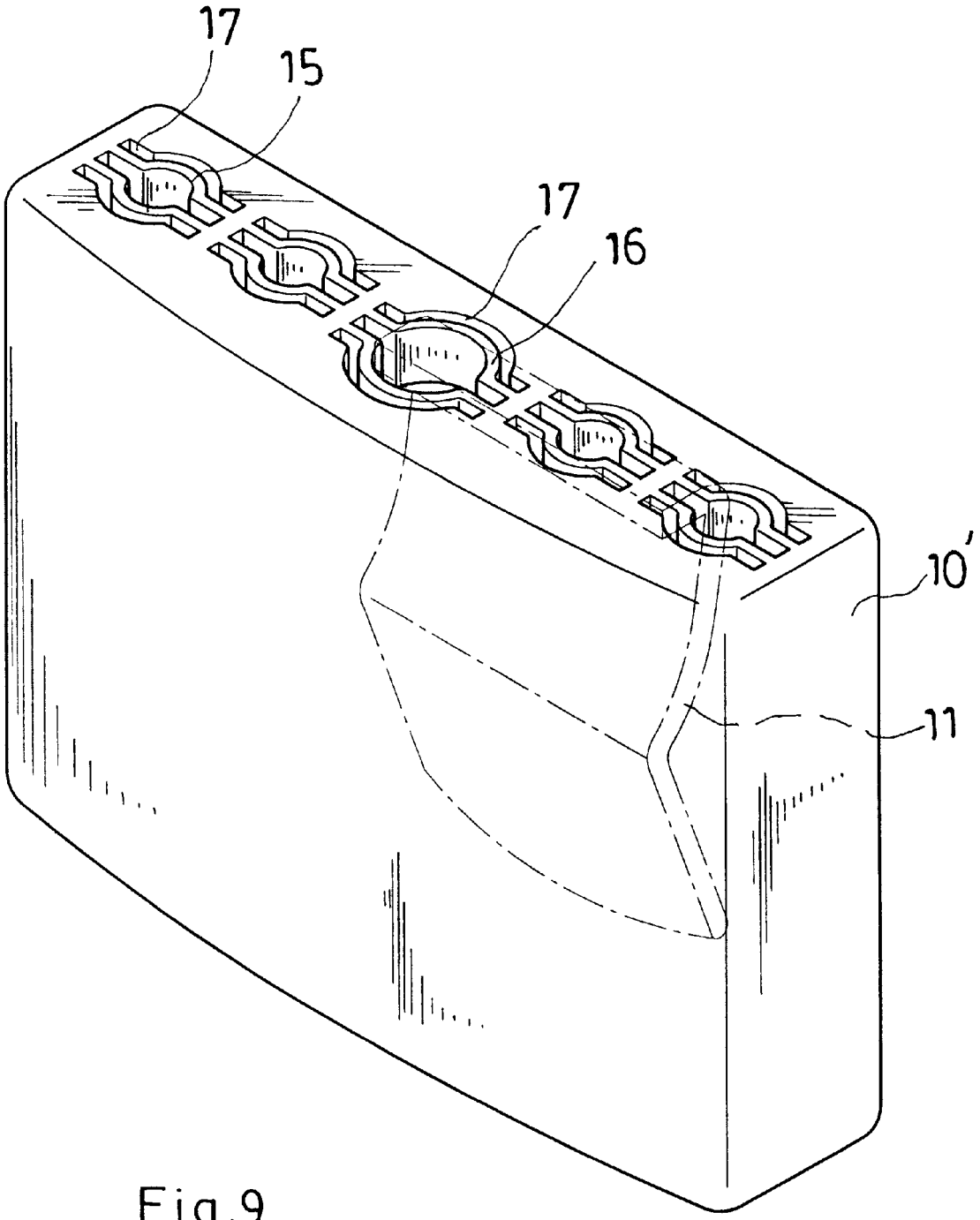
FIG. 9 is another embodiment of the present invention.
Figure 10:
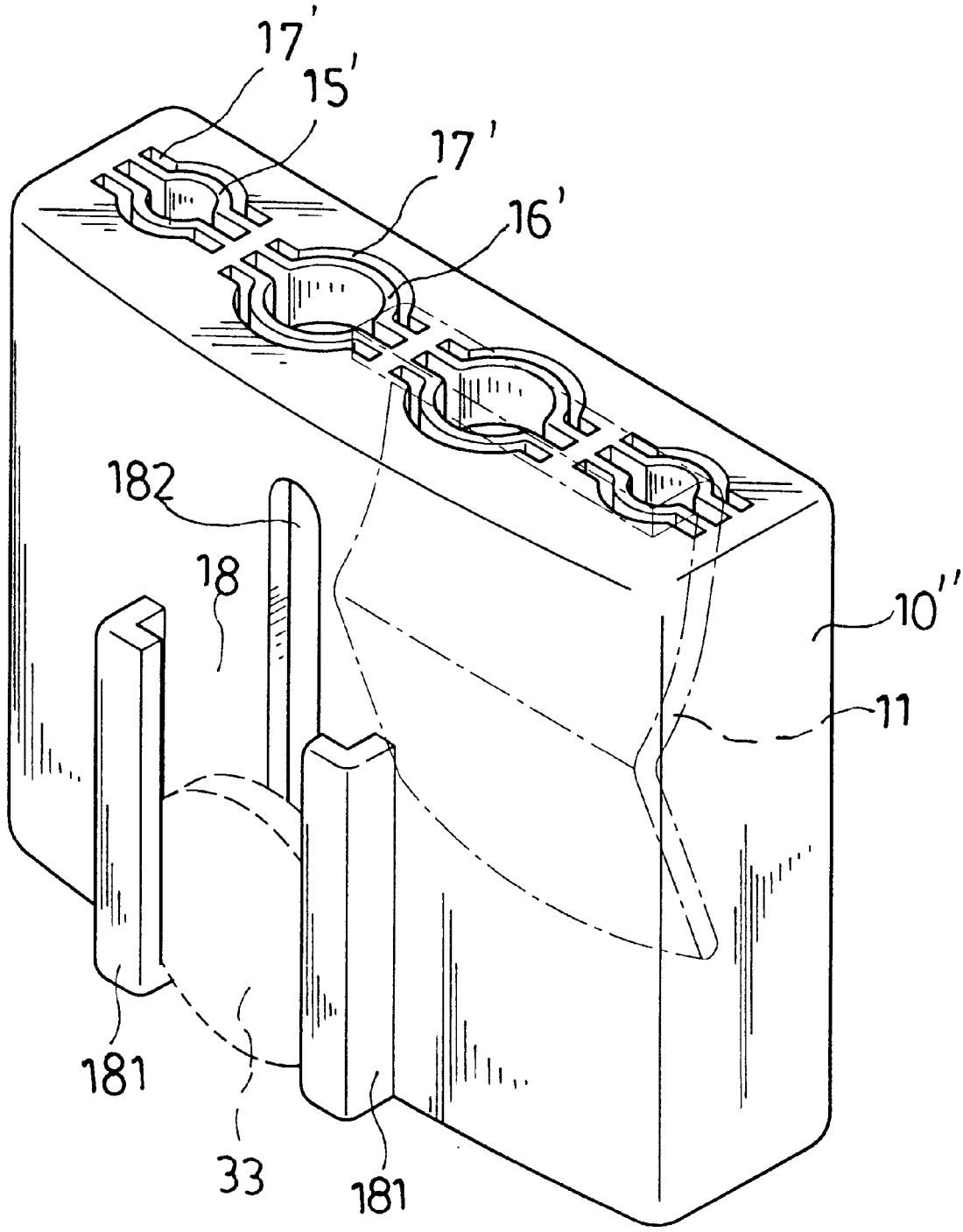
FIG. 10 is one other embodiment of the present invention.

Furthermore, the disposition of the present invention can be varied in according with the users'requirement, for instance, as shown in FIG. 9, all the embedded channels and ribbed strip on the opposite side of the buckled clip 11 of the fastening stand 10' can be removed in order to make golfers carry only tees 31 in different size, in this way, golfers will have relative light burden in their fastening stand. Referring to FIG. 10, another example shows that only a fourth embedded channel 18 is set up on the opposite side of the buckled clip 11 of the fastening stand 10" for the ball location markers 33 to be inserted in, similarly, an L-shape ribbed strip 181 is set up in the fourth embedded channel 18 wherein a long slot 182 is also set up at its center to hide the sharp tip of the markers 33 to avoid exposing those sharp tips lest those markers 33 should hurt anybody, moreover, a plurality of resilient clipping pieces 15', 16' having symmetrical pair with their both ends extended outward to form resilient clipping device are set up at the top of the hollow fastener stand 10" between the buckled clip 11 land the adjacent embedded channels 18 while slots 17' are also set up on each side of the resilient clipping pieces 15', 16' to allow the elastically expansive spaces for the resilient clipping pieces 15', 16' for clipping different size of tees 34.

Although the present invention has been illustrated and described previously with reference to the preferred embodiments thereof, it should be appreciated that it is in no way limited to the details of such embodiments, but is capable of numerous modification within the scope of the appended claims.

What is claimed is:

1. A fastening device for holding a golf club implement set, said device comprising:

a fastening stand in the form of a rectangular hollow body, said stand including a top surface, a downwardly facing opening, a first side and a second side opposite said first side;

a clip attached to said first side of said fastening stand wherein said clip is configured for attaching said fastening device to a person's waist belt;

a plurality of embedded channels on said second side of said fastening stand wherein:

a first embedded channel is configured for the insertion of a brush therein, said first embedded channel including a rectangular opening which is configured for the insertion of brush hair of said brush into said fastening stand;

a second embedded channel is configured for insertion of a ball location marker therein, said second embedded channel including a slot which is configured for the insertion of a sharp tip of said ball location marker into said fastening stand;

a plurality of top openings along said top surface of said fastening stand, said top openings being configured for the insertion of different sized golf tees therein; each of said top openings including a resilient clip member for resiliently holding said different sized golf tees.

2. The fastening device of claim 1 wherein each of said embedded channels are defined by a pair of L-shaped ribbed strips attached to said second side of said fastening device.

3. The fastening device of claim 2 wherein the pair of L-shaped ribbed strips of said first embedded channel is of a different length than the pair of L-shaped ribbed strips of said second embedded channel.

4. The fastening device of claim 3 wherein each of said ribbed strips have a bottom end and each bottom end is connected to said second side of said fastening stand with a closed type connection.

5. The fastening device of claim 1 wherein each of said resilient clip members comprise a pair of symmetrical semi-circular arcs of resilient material, said semi-circular arcs of resilient material being configured for resilient engagement around said golf tees.

6. The fastening device of claim 1 wherein said second embedded channel is located opposite said clip and said slot is located at the center of said second embedded channel.

* * * * *